US005979605A

United States Patent [19]

Popp

[11] Patent Number: 5,979,605

[45] Date of Patent: Nov. 9, 1999

[54] ADJUSTABLE VEHICLE SERVICE AREA AND SERVICE WALKWAY

[76] Inventor: Thomas J. Popp, 10234 W. Grove School Rd., Beloit, Wis. 53511

[21] Appl. No.: 08/943,627

[22] Filed: Oct. 3, 1997

Related U.S. Application Data

[60] Provisional application No. 60/029,005, Oct. 23, 1996.

[51] Int. Cl.[6] ..... B66F 7/00

[52] U.S. Cl. ..... 187/205; 187/215

[58] Field of Search ..... 187/205, 203, 187/215, 272, 273; 254/93 R, 93 HP, 93 L, 87 R

[56] References Cited

U.S. PATENT DOCUMENTS

| | | | |
|---|---|---|---|
| 2,610,824 | 3/1952 | Grier | 254/93 |
| 3,174,722 | 3/1965 | Alm | 254/93 |
| 3,783,976 | 1/1974 | Kerr | 187/215 |
| 4,275,869 | 6/1981 | Clements | 254/89 H |
| 4,323,141 | 4/1982 | Ragan et al. | 187/8.47 |
| 4,724,930 | 2/1988 | VanLierop | 187/8.43 |
| 5,178,367 | 1/1993 | Vaughen | 254/93 HP |
| 5,481,774 | 1/1996 | Hodges et al. | 14/71.7 |
| 5,542,806 | 8/1996 | Kang | 414/422 |

*Primary Examiner*—Kenneth W. Noland
*Attorney, Agent, or Firm*—Craig A. Fieschko, Esq.; DeWitt Ross & Stevens S.C.

[57] ABSTRACT

A service area is provided with a service area floor having a service pit sunken therein. A service lift is then provided within the service pit, and the service lift includes a service platform which is adjustable between a lowermost height to an uppermost height substantially equal to the height of the service area floor. Service personnel situated on the service platform within the service pit may thus actuate the service platform to various heights within the pit to allow comfortable servicing of the underside of a vehicle without the need to crouch or resort to the use of stepladders. The service platform can also be lifted to its uppermost height to effectively close the service pit, thereby enhancing the safety of the service area. The service lift most preferably uses air springs to effect the actuation of the service platform.

16 Claims, 2 Drawing Sheets

FIG. 1
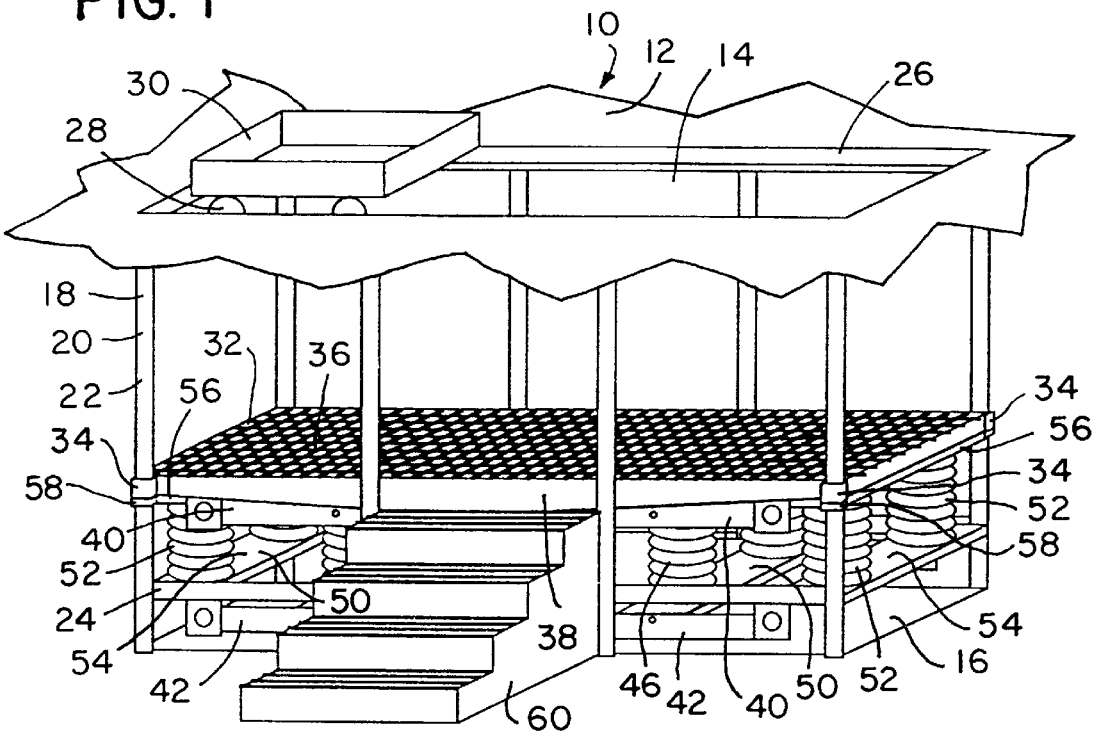
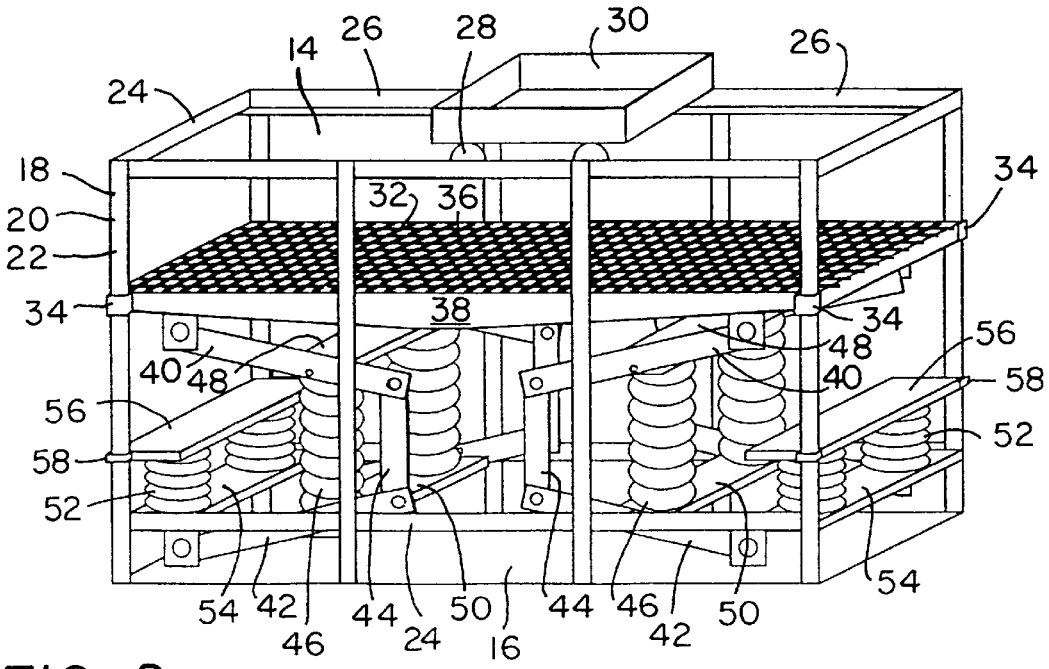
FIG. 2

ADJUSTABLE VEHICLE SERVICE AREA AND SERVICE WALKWAY

CROSS-REFERENCE TO RELATED APPLICATIONS

This application claims priority under 35 USC §119(e) to U.S. Provisional Patent Application 60/029,005 filed Oct. 23, 1996, the entirety of which is incorporated by reference herein.

FIELD OF THE INVENTION

This disclosure concerns an invention relating generally to vehicle service areas allowing access to the undersides of vehicles, and more specifically to such service areas wherein service personnel are provided with the ability to vary the height between the undersides of vehicles and the walkways beneath the undersides of the vehicles.

BACKGROUND OF THE INVENTION

Vehicle service lifts are well-known apparata used to lift vehicles to allow access to their undersides for service purposes. Many vehicle owners own vehicle jacks which allow one side of a vehicle to be lifted to allow changing of tires or other maintenance functions. In professional service shops, vehicle lifts are generally significantly larger and provide tracks whereupon the wheels of a vehicle may be placed. The tracks (and the entire vehicle) are then lifted so that the underside of the vehicle is accessible to service personnel. The vehicle is lifted to such a height that service personnel may operate on the underside of the vehicle with comfort and convenience. An example of such a vehicle lift may be found in U.S. Pat. No. 4,724,930 to VanLierop. Such vehicle lifts are generally quite expensive, and while models can be constructed which accommodate a wide variety of different types and sizes of vehicles, it is impractically expensive to construct service lifts which can accommodate every conceivable vehicle size and weight. As an example, some dual-use vehicles (i.e., all-terrain vehicles which are intended for both off-road and on-road use, such as the HUMMER or HUMVEE manufactured by AM General Corporation) have wheelbases which are significantly larger than standard vehicles, and these cannot be accommodated by any known vehicle lift. As another example, semi tractors are often too large and heavy to allow the use of a vehicle lift. Vehicles such as these are generally serviced by use of a service pit.

A service pit is a pit in a service area floor which is sized so that a vehicle can drive over the pit with the vehicle's wheelbase spanning the pit. Service personnel located in the pit and beneath the underside of the vehicle may reach up to operate on the underside of the vehicle. Service pits are often formed by forming a hole in the service area floor extending to the basement, and reinforcing the surrounding basement ceiling. In this case, since the basement floor may be eight or more feet beneath the underside of vehicles parked over the service pits, a raised platform may be provided on the basement floor beneath the service pit to allow service personnel to more easily reach the undersides of the vehicles. Service pits are advantageous in that they are low in cost and maintenance compared to vehicle lifts, and they can be made with a length sufficient to traverse not only a semi tractor, but an attached trailer as well.

However, service pits are often not viewed as favorably as vehicle lifts by government agencies dealing with workplace safety (e.g., the Occupational Safety and Health Administration, or OSHA), by insurance companies, and even by service shop operators since they present a greater likelihood for accident. It can be disastrous if a vehicle is improperly driven over the service pit and one or more wheels happen to fall into the service pit. Additionally, an open service pit poses a falling hazard for distracted or inattentive service personnel who are walking about the service area. This is particularly true since the service area is often noisy and the service personnel may be wearing welding gear, carrying equipment, or engaging in other activities which may decrease visibility or attentiveness.

Service pits also pose a problem in that their floors may not be optimally spaced from the undersides of vehicles parked thereover. Since the ground clearances of different vehicles can vary radically—from a foot or so for sports cars to several feet for semi tractors—service personnel may need to crouch or stoop in service pits, or may alternatively need to work on stepladders. When service procedures are lengthy, this can be very tiring for service personnel. This is undesirable because fatigue significantly amplifies the chance of accident. Additionally, working in crouched or extended positions for long periods of time can lead to spinal misalignment and other back injuries.

SUMMARY OF THE INVENTION

The invention, which is defined by the claims set out at the end of this disclosure, is intended to solve the problems noted above. A service area is provided with a service area floor having a service pit sunken therein. A service lift is then provided within the service pit, and the service lift includes a service platform which is adjustable between a lowermost height above the service pit floor to an uppermost height substantially equal to the height of the service area floor. Service personnel situated on the service platform within the service pit may thus actuate the service platform to various heights within the pit to allow comfortable servicing of the underside of a vehicle without the need to crouch or resort to the use of stepladders. Before a vehicle is located over the service pit, the service platform may be raised to the uppermost height to prevent vehicles from being inadvertently driven into the service pit. After vehicles are removed from the service area, the service platform may be raised to the uppermost height to prevent service personnel or equipment from inadvertently falling into the service pit. Because the service platform supports service personnel rather than vehicles, the service platform and the lifting means used to adjust its height need not be as ruggedly constructed as a vehicle lift used to lift vehicles. The service platform may nevertheless be sufficiently strong that it can temporarily support a vehicle which is inadvertently misaligned with the service pit and which has one or more wheels placed on the service platform. Additionally or alternatively, the service area may include a locking mechanism which selectively locks the service platform in its uppermost position so that a vehicle which inadvertently has one or more wheels placed atop the service platform will be supported by the service platform so that it does not fall into the service pit.

To achieve greater versatility, the service lift is preferably provided with a fine lift for allowing a fine degree of adjustment of service platform heights between its lowermost height and an intermediate height below the uppermost height, and a coarse lift allowing the service platform to be lifted to its uppermost height. The fine lift is intended for use by service personnel to finely adjust the service platform to a comfortable height. The coarse lift is intended to rapidly adjust the service platform to the uppermost height to effectively close the service pit with respect to the service area floor. The fine and coarse lifts are most preferably provided by air springs, which are pneumatic actuators commonly used in semi tractors/trailers and other heavy trucks as shock absorbers. Other fluid actuators (e.g., pneumatic or hydraulic cylinders) or mechanical or electromechanical actuators may be used instead, but air springs are particularly preferred owing to their low cost and their extremely high weight capacity. The fine and coarse lifts may also encompass associated mechanisms such as scissors linkages for better effecting the action of the fluid (or other) actuators.

Since actuators of virtually any type grow in expense as their range of motion (e.g., stroke length) increases, a particularly inexpensive and effective arrangement is provided by having the fine lift act directly against the service platform when finely adjusting its height for service personnel, and then having it disengage from the service platform when the coarse lift adjusts the service platform to its uppermost height. The actuator of the fine lift therefore needs only a small range of motion and can be inexpensively provided. By utilizing a scissors linkage or similar motion-amplifying linkage in the coarse lift, the actuator of the coarse lift can also require only a small range of motion since the linkage will amplify such motion.

Further advantages, features, and objects of the invention will be apparent from the following detailed description of the invention in conjunction with the associated drawings.

BRIEF DESCRIPTION OF THE DRAWINGS

FIG. 1 is a front perspective view of the service area of the present invention, illustrated with the service lift positioned at its lowermost height.

FIG. 2 is a front perspective view of the service lift of FIG. 1, with the access stairway and service area floor removed and with the coarse lift positioning the service platform at such a height that the fine lift is disengaged from the service platform.

DETAILED DESCRIPTION OF PREFERRED EMBODIMENTS OF THE INVENTION

Figure 3:
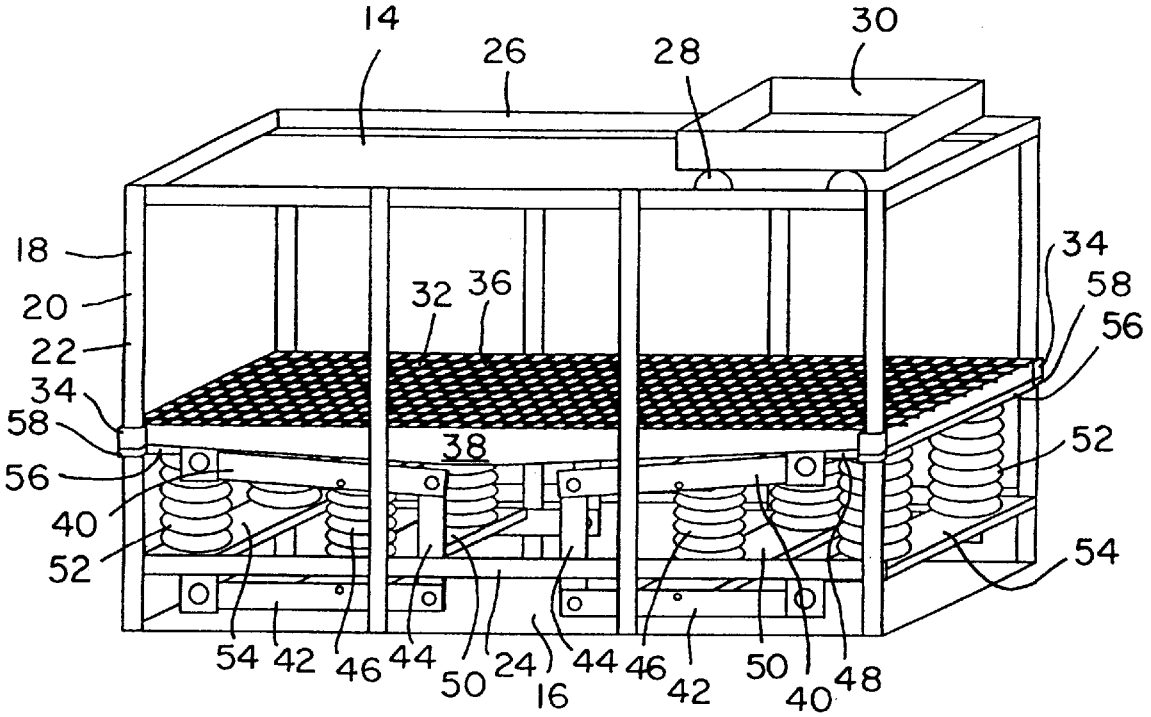
FIG. 3 illustrates the service lift of FIG. 2 wherein the service platform is partially lifted by the fine lift.

In the drawings, wherein the same or similar features of the invention are designated in all Figures with the same reference numerals, a service area in accordance with the invention is illustrated in FIG. 1 at the reference numeral 10. The service area 10 includes a service area floor 12 having a service pit 14 sunken therein. The service pit 14 could, for example, be formed by cutting a hole in the service area floor 12 to allow access to an underlying basement, and then reinforcing the service area floor 12 surrounding the hole. Alternatively, the service pit 14 could simply be formed directly in a service area floor 12. The service pit 14 will generally have a service pit floor 16 situated 7–12 feet beneath the level of the service area floor 12.

A service lift 18 is then situated within the service pit 14. The service lift 18 includes a frame 20 having generally vertical stanchions 22 spaced about the perimeter of the service pit 14 and extending from the service pit floor 16 to the general height of the service area floor 12. Within the frame 20, the stanchions 22 may be maintained in fixed positions by stanchion connecting members 24 extending between stanchions 22. The frame 20 preferably has its stanchions 22 affixed to the service pit floor 16, e.g., by providing the bottoms of the stanchions 22 with mounting pads (not shown) which are bolted to the service pit floor 16. The frame 20 is preferably made of square steel or aluminum tubing, though a variety of other materials may be assembled in other configurations to construct the frame 20.

At the top of the frame 20, opposing stanchion connecting members 26 may be made of steel or aluminum angle members which function as a cart track for the wheels 28 of a rolling service cart 30. The service cart 30 may thus be rolled to different positions across the top of the service pit 14 with its wheels 28 rolling on the service cart track 26 slightly below the level of the service area floor 12.

A service platform 32 is then provided within the frame 20 of the service lift 18. The service platform 32, which is slidably affixed at its corners to the frame 20 via platform collars 34 encircling stanchions 22, is restrained to move to varying heights within the frame 20 between the service pit floor 16 and the service area floor 12. The service platform 32 includes a platform walkway 36 whereupon service personnel may walk. The platform walkway 36 is preferably made of a foraminated non-skid surface, such as strips of steel or aluminum having a corrugated/serrated upper surface, with the strips being welded together to form a grid. The platform walkway 36 is situated atop a platform basin 38, a receptacle which is preferably formed of sheet steel or aluminum and which inclines downwardly towards its center. This allows oil or other fluids falling onto the service platform 32 to run through the foraminated platform walkway 36 and into the platform basin 38, where the fluids will then run towards the lowermost point of the platform basin 38 at its center. A drain (not shown) may then be formed at the lowermost point of the platform basin 38 to allow draining of the fluids when desired.

A lifting means for lifting the service platform 32 to varying heights within the frame 20 of the service lift 18 is then provided. Such a lifting means is preferably provided in two parts: a coarse lift for rapidly lifting the service platform 32 to varying heights between its lowermost height and an uppermost height substantially equal to the height of the service area floor 12, and a fine lift for more slowly and gradually lifting the service platform 32 to varying heights between its lowermost height and an intermediate height less than the uppermost height. The coarse lift is primarily intended to allow rapid opening and closing of the service pit 14, and the fine lift is primarily intended to allow fine adjustment of the height of the service platform 32 to accommodate the comfort of service personnel. Each of the coarse lift and fine lift will now be discussed in turn.

As noted above, a coarse lift is provided to lift the service platform 32 to varying heights between its lowermost height and an uppermost height substantially equal to the height of the service area floor 12. The exemplary coarse lift shown in the Figures, most particularly in FIGS. 2–3, includes an amplifying linkage including upper link 40, lower link 42, and intermediate link 44. The amplifying linkage amplifies the motion provided by a coarse fluid actuator 46, i.e., a pneumatic or hydraulic actuator. To explain in greater detail, at the opposing lateral sides of the service platform 32, the upper link 40 is pivotally linked to the service platform 32, the lower link 42 is pivotally linked to the frame 20, and the intermediate link 44 is then pivotally linked between the upper and lower links 40 and 42. The coarse fluid actuators 46 have their opposing tops and bottoms affixed to upper and lower coarse actuator bars 48 and 50. The upper coarse actuator bars 48 are pivotally linked to the laterally-spaced upper links 40 of the coarse lift, and the lower coarse actuator bars 50 are pivotally linked between the laterally-spaced lower links 42 of the coarse lift. Thus, as illustrated particularly by FIGS. 1 and 2, when the coarse fluid actuators 46 expand, they push the upper and lower coarse actuator bars 48 and 50 apart to separate the upper and lower links 40 and 42 and thereby push the service platform 32 upwardly. The amplifying linkage provided by the upper, lower, and intermediate links 40, 42, and 44 amplifies the smaller range of movement provided by the coarse fluid actuators 46 into a greater range of movement for the service platform 32.

Preferably, the coarse fluid actuators 46 are provided by air springs, pneumatically-driven expansible and contractible cylinders which have primarily been used as shock absorbers for semi tractors, semi trailers, and the like. Air springs are generally not regarded as being effective fluid actuators because of their relatively low range of effective motion (i.e., low stroke length), their inability to withstand forces off of their axes (i.e., their tendency to fold over between their ends if subjected to off-axis forces), and their ineffectiveness in contraction (i.e., they push well, but do not pull well). They are primarily known for their extremely high weight capacity (6–7 tons apiece) and low cost (approximately $150 per spring as of 1997). Pneumatic or hydraulic cylinders could be used as the fluid actuators 46 instead of air springs, and these would offer the advantages that they are not subject to off-axis deflection and they generally have strength in both expansion and contraction strokes. However, pneumatic or hydraulic cylinders are not preferred because cylinders having a weight capacity similar to that of air springs cost approximately $3,000 as of 1997.

If air springs are used as the coarse fluid actuators 46, to reduce the possibility that the air springs may bulge outwardly in an off-axis direction during expansion, the upper and lower coarse actuator bars 48 and 50 can be further restrained to move along a path wherein they are always in parallel spaced relation. This can be done, for example, by providing a vertically-extending rod or track from one (or both) of the coarse actuator bars 48/50 to the opposite coarse actuator bar, whereupon a collar is provided for receiving the rod/track. Such an arrangement, which is not shown in the Figures, confines the coarse actuator bars 48/50 so they can only move in parallel, vertically-spaced relationship. This is merely an exemplary way of maintaining the coarse actuator bars 48/50 in parallel vertical relationship, it being understood that one skilled in general mechanical design could develop alternative means for preventing off-axis bending of the air springs.

The service lift 18 further includes a fine lift within its frame 20 for lifting the service platform 32 to varying heights between its lowermost height and an intermediate height below the uppermost height. With special reference to FIG. 2, the fine lift utilizes fine fluid actuators 52 (e.g., air springs) supported at their bottoms by lower fine actuator bars 54 affixed to the frame 20, and affixed at their tops to upper fine actuator bars 56 which are restrained to move vertically via collars 58 extending about the stanchions 22 of the frame 20. The service platform 32 is not connected to the upper fine actuator bars 56 but is freely supported thereon. Thus, the upper fine actuator bars 56 may support the service platform 32 so long as the service platform is not lifted off of the upper fine actuator bars 56 by the coarse lift. Since the fine fluid actuators 52 and lower and upper fine actuator bars 54 and 56 of the fine lift are not associated with any amplifying linkage, the fine lift cannot lift the service platform 32 to the uppermost height provided by the coarse lift unless the fine fluid actuators 52 have a substantially large stroke. Since this would entail significant expense for the fine fluid actuators 52, the fine lift is preferably only capable of lifting the service platform 32 to an intermediate height beneath the uppermost height. If it is then desired to lift the service platform 32 from the intermediate height to the uppermost height, the coarse lift can be used to lift the service platform 32 upwardly off of the upper fine actuator bars 56.

While it might seem desirable to utilize only a single lifting means which allows adjustment of the height of the service platform 32 fully between the lowermost height and the uppermost height, there are distinct advantages gained by use of dual coarse and fine lifts. Since the fine lift illustrated in the Figures omits any amplifying linkage, it provides slow and gradual height control across the range of height settings desirable for use by service personnel. It is thus quite easy to very finely adjust the height of the service platform 32 to the precise level desired. On the other hand, the amplifying linkage of the coarse lift allows very rapid lifting of the service platform 32 to the uppermost position to close the service pit 14. Further, where the service area 10 uses coarse and fine lifts using air springs as the coarse and fine fluid actuators 46 and 52, the service area 10 can still be provided at radically lesser cost than a service area using pneumatic or hydraulic cylinders having comparable weight capacity. This is even true if the service area utilizes only a single lifting means which lifts the service platform 32 between the lowermost and uppermost heights, rather than dual coarse and fine lifts. In short, dual coarse and fine lifts utilizing air springs can be provided at lesser cost and with greater functionality than a single lifting means utilizing hydraulic or pneumatic cylinders.

In operation, when the service area 10 is not in use, the service platform 32 is raised to its uppermost height substantially equal to the service are floor 12 to prevent service personnel from falling into the service pit 14. A vehicle may be driven over the service pit 14 of the service area 10 with its side wheels resting outside the opposing lateral sides of the service pit 14 and service lift 18. The service platform 32 is then lowered to its lowermost height, as shown in FIG. 1, by fully deflating the coarse and fine fluid actuators 46 and 52 of the coarse and fine lifts. Service personnel within the service pit 14 can then walk onto the service platform 32 via access stairway 60 (shown only in FIG. 1). If the service platform 32 does not provide a comfortable distance for the service personnel working on the underside of the vehicle, the fine lift may be actuated to lift the service platform 32 upwardly to a more comfortable height. The service personnel may then work on the underside of the vehicle until all necessary tasks are completed. The service cart 30 may be rolled to different locations beneath the vehicle to carry heavier tools or to catch fluid leaks. The service personnel may then leave the service platform 32 by use of the access stairway 60 (perhaps lowering the service platform 32 to a level closer to the access stairway 60 if desired), and the service platform 32 is then raised by the coarse lift to its uppermost height substantially level with the service area floor 12. As this occurs, the service platform 32 will disengage from the upper fine actuator bar 56 of the fine lift. The vehicle can then be driven out of the service area 10.

The valves and pneumatic/hydraulic supplies used in actuating the fluid actuators 46 and 52 of the coarse and fine lifts are not shown or described above because the installation and placement of such valves and supplies is a matter of ordinary skill, and can vary in accordance with the preferences of service personnel. A particularly preferred arrangement is to provide valving for the coarse lift at the service area floor 12, and also within the service pit 14, perhaps mounted on the frame 20. This allows service personnel both inside and outside the service pit 14 to raise and lower the service platform 32 to its uppermost position, thereby avoiding any need for service personnel to climb into or out of the pit 14 to raise the service platform 32. An actuating valve for the fine lift can be mounted on the interior of the frame 20 within the service pit 14 so that personnel standing on the service platform 32 can actuate it and move the service platform 32 to different comfortable heights.

Figure 4:
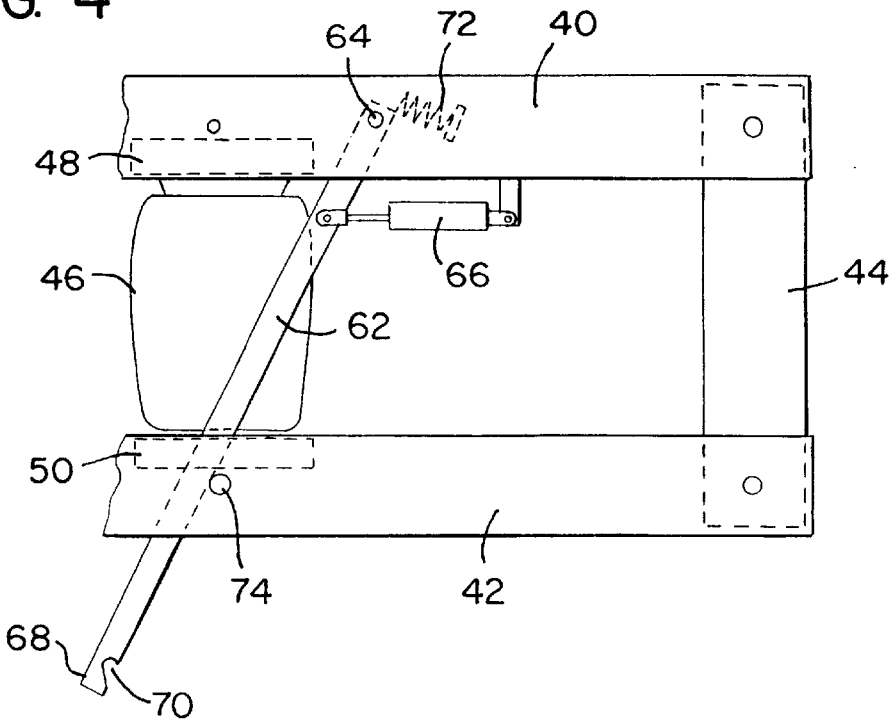
FIG. 4 provides a partial side elevational view of a coarse lift of the service areas of FIGS. 1–3 with an exemplary lock which may be used to lock the service platform in its uppermost position.

An optional (but preferable) feature of the service area 10 is a lock which selectively locks the service platform 32 in its uppermost position to reinforce the service platform 32 and deter its collapse, e.g., if one or more wheels of a vehicle should inadvertently be placed on the service platform 32. An exemplary lock is illustrated in FIG. 4 in conjunction with the links 40, 42, and 44 of a coarse lift. A lock bar 62 is pivotally linked to upper link 40 at pin 64. An air cylinder 66 is pivotally connected between the lock bar 62 and the upper link 40 of the coarse lift. The lock bar 62 has a lock end 68 bearing an engagement slot 70 located generally near the lower link 42, and at the opposite end of the lock bar 62 from the pin 64. A spring 72 is biased against the end of the lock bar 62 opposite the lock end 68. The lock bar 62 is thus spring-biased to drive the engagement slot 70 of the lock end 68 into connection with a pin 74 on the lower coarse actuator bar 50 of the coarse lift when the coarse lift lifts the service platform 32 to its uppermost position. Thus, as soon as the service platform 32 is moved into its uppermost position, the lock bar 62 will lock it into place. To disengage the lock, the engagement slot 70 may be disengaged from the pin 74 of the lower coarse actuator bar 50 by charging air cylinder 66 sufficiently to move the lock bar 62 outwardly, defeating the force of the spring 72.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, the invention encompasses coarse and fine lifts which utilize other than air springs as their fluid actuators. Air springs are particularly advantageous for use in the invention, but pneumatic or hydraulic cylinders or other fluid actuators may be used as well. Mechanical and electromechanical actuators could additionally or alternatively be used.

Second, the invention encompasses coarse and fine lifts utilizing a variety of structures apart from the actuator bars and three-bar linkage shown in the Figures. The mechanical arts are replete with examples of mechanisms for effecting lifting motions, e.g., scissors linkages, two- or four-bar linkages, screw actuators, ratcheting mechanisms, etc. The adaptation of the embodiment of the invention shown in the Figures to utilize any one or more of these mechanisms is within the purview of an ordinarily-skilled artisan. As examples of alternate arrangements for the coarse lift, the lower link 42 could be affixed to the service pit floor 16 rather than the frame 20; the intermediate link 44 could be eliminated and the upper and lower links 40 and 42 could be directly connected; or the intermediate link 44 could be rigidly connected to one of the upper and lower links 40 and 42. As an example of an alternate arrangement for the fine lift, the lower fine actuator bar 54 could be lowered to the level of the service pit floor 16, and could then be eliminated if desired.

Third, the invention encompasses the use of a single lift in place of the coarse and fine lifts, though the use of dual coarse and fine lifts is preferable where air springs are used. However, if more expensive fluid actuators such as pneumatic or hydraulic cylinders are used, it may be more feasible to simply use a single lift where the actuators have an acceptable range of force and motion.

Fourth, it is also within the skill of an ordinary artisan to select or design a lock different from the one shown and described to allow affixation of the service platform 32 in its uppermost height. A simple example of an alternate lock would be the use of an insertable pin which engages the service platform 32 to the service cart tracks 26, or other structure which affixes the service platform 32 to the service cart tracks 26 (e.g., a latch swinging out to engage the platform 32 and tracks 26, or spring-loaded prongs on the frame 20 which automatically engage the platform 32 when it is lifted above or adjacent the prongs). Another example is the inclusion of a ratcheting structure between the service lift stanchions 22 and the service platform 32 (or its collars 34).

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A service area comprising:

a. a service platform restrained to move in a vertical direction with respect to an operating environment;

b. a coarse lift including:

(1) a bar pivotally linked to the service platform;

(2) a coarse fluid actuator connected to the bar to lift the service platform;

c. a fine lift including a fine fluid actuator having a datum end fixed with respect to the operating environment and a service platform end acting against the service platform, the fine fluid actuator being actuable to exert force between the first and service platform ends.

2. The service area of claim 1 wherein the operating environment includes a service area floor having a service pit sunken therein, wherein the service platform is situated within the service pit.

3. The service area of claim 2:

wherein the coarse lift is actuable to move the service platform to varying heights across a lift range defined by a lowermost height and an uppermost height, the uppermost height being substantially equal to the height of the service area floor, and further wherein the fine lift is actuable to move the service platform to varying heights between the lowermost height and an intermediate height below the uppermost height.

4. The service area of claim 3 wherein the service platform disengages from the fine lift when moved above the intermediate height.

5. The service area of claim 1 wherein the service platform end of the fine fluid actuator is unconnected to the service platform, the service platform thereby being movable with respect to the service platform end.

6. The service area of claim 3 wherein the service area includes a lock selectively affixing the platform at its uppermost height.

7. A service area comprising:

a. a service platform restrained to move in a substantially vertical direction across a lift range defined by a lowermost height and an uppermost height, and b. a fine lift actuable to move the service platform between the lowermost height and an intermediate height below the uppermost height.

8. The service area of claim 7 further comprising a coarse lift actuable to move the service platform between the lowermost height and the uppermost height, wherein the service platform disengages from the fine lift when moved above the intermediate height.

9. The service area of claim 7 wherein the service platform is situated within a service pit sunken within a service area floor, and wherein the uppermost height is substantially equal to the height of the service area floor.

10. The service area of claim 7 further comprising a lock selectively affixing the service platform at its uppermost height.

11. A service area comprising:

a. a service area floor having a service pit sunken therein, the service pit having a service pit floor, and b. a service lift within the service pit, the service lift including:

(1) a service platform adjustable to varying heights across a lift range defined by a lowermost height and an uppermost height, the uppermost height being substantially equal to the height of the service area floor; and (2) a fine lift engaging the service platform, the fine lift being adapted to lift the service platform to varying heights between the lowermost height and an intermediate height below the uppermost height.

12. The service area of claim 11 wherein the service lift includes a coarse lift engaging the service platform, the coarse lift being adapted to lift the service platform to varying heights across the lift range.

13. The service area of claim 12 wherein the fine lift disengages from the service platform when the service platform is lifted to heights between the intermediate height and the uppermost height.

14. The service area of claim 11 wherein the service lift includes a frame bearing a coarse lift adapted to lift the service platform to varying heights across the lift range.

15. The service area of claim 14 wherein the coarse lift includes a bar pivotally linked to the service platform and a coarse fluid actuator acting on the bar to lift the service platform.

16. The service area of claim 11 including a lock selectively affixing the service platform in its uppermost height.

* * * * *